US010957193B2

(12) United States Patent
Kurehashi et al.

(10) Patent No.: US 10,957,193 B2
(45) Date of Patent: Mar. 23, 2021

(54) DRIVING ASSISTANCE SYSTEM FOR VEHICLE

(71) Applicant: HONDA MOTOR CO., LTD., Tokyo (JP)

(72) Inventors: Takahiro Kurehashi, Wako (JP); Yoshinori Kinoshita, Wako (JP); Hiroki Nakajima, Wako (JP); Masataka Izawa, Wako (JP); Hiroshi Kamakura, Wako (JP); Minoru Kobayashi, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 16/824,238

(22) Filed: Mar. 19, 2020

(65) Prior Publication Data

US 2020/0312139 A1 Oct. 1, 2020

(30) Foreign Application Priority Data

Mar. 28, 2019 (JP) ..... JP2019-064520

(51) Int. Cl.
*G08G 1/0967* (2006.01)

(52) U.S. Cl.
CPC . *G08G 1/096716* (2013.01); *G08G 1/096783* (2013.01)

(58) Field of Classification Search
None
See application file for complete search history.

(56) References Cited

U.S. PATENT DOCUMENTS 6,989,766 B2 * 1/2006 Mese ..... G08G 1/096716 340/907
2017/0067385 A1 * 3/2017 Hunt ..... B60W 40/09
2017/0364080 A1 * 12/2017 Chintakindi ..... B60W 50/082

FOREIGN PATENT DOCUMENTS

JP 2010-244308 A 10/2010

* cited by examiner

*Primary Examiner* — Thomas S McCormack
(74) *Attorney, Agent, or Firm* — Rankin, Hill & Clark LLP

(57) ABSTRACT

The reception unit receives the traffic light information at least a transition between first and second light colors of a traffic light at an intersection and turn-on times of the first and the second light colors, using a wireless signal received from a server via a transceiver. A position acquisition unit acquires a position of a vehicle. A passing speed range calculation unit calculates a speed range in which the vehicle is allowed to pass through the intersection in accordance with light colors of the traffic light, based on the traffic light information and on the position of the vehicle. The messaging unit outputs a message of driving assistance information including suggestions for deceleration or a passage possibility through the traffic intersection. A vehicle behavior storing unit stores content of the message and a behavior of the vehicle corresponding to the content of the message in a behavior memorizing unit.

3 Claims, 3 Drawing Sheets

DRIVING ASSISTANCE SYSTEM FOR VEHICLE

CROSS-REFERENCE TO RELATED APPLICATIONS

This application is based upon and claims the benefit of priority from Japanese Patent Application No. 2019-064520 filed on Mar. 28, 2019; the entire contents of which are incorporated by reference.

TECHNICAL FIELD

The disclosure relates to a driving assistance system for vehicle.

BACKGROUND ART

Japanese open-laid patent application of JP2010244308A discloses a technology in which information about traffic lights is received externally at a traffic intersection, enabling the vehicle to go through the traffic intersection with help of the received traffic light information.

SUMMARY OF INVENTION

Technical Problem

The Traffic Signal Prediction Systems (TSPS) is known as a drive-assisting system for enabling a vehicle to pass smoothly thorough traffic intersections with help of the traffic lights information obtained from an optical beacon.

In this system, it is also possible to provide the traffic light information from a server to the vehicle via a wireless communication.

However, a vehicle, which utilizes this system, determines its position by use of a satellite positioning system such as the GPS (Global Positioning System), and determines whether the vehicle can pass through the intersection in a certain speed range with a sufficient margin, or whether the vehicle should decelerate before the intersection because it is difficult to pass through the intersection, and the vehicle further messages to the driver about these as assistance information. The processing related to such determinations is conducted by an on-board driving assistance system for the vehicle.

The current position of the vehicle, as determined by the satellite positioning system, may be inaccurate dependent on the surrounding environment. Thus, it may happen that the vehicle is travelling not on a road which is determined by the satellite system to be the currently travelling road of the vehicle, but on a road parallelly running thereto.

In such a case, the traffic signal information transmitted from the server to the vehicle via the wireless communication is useless, and therefore the driver drives the vehicle irrespective of the assistance information based on the traffic lights information.

Thus, the object of the disclosure is to realize a driving assistance system which conducts an in-situ processing, adapted to the current condition.

Solution to Problem

The disclosure is a driving assistance system for vehicle, including: a reception unit configured to receive from an external server traffic light information including at least a transition between first light color and second light color of the traffic light located at an intersection and turn-on times of the first light color and the second light color, a remaining distance calculation unit configured to calculate a remaining distance from the vehicle's position to the intersection, a passing speed range calculation unit configured to calculate a passing speed range of the vehicle, based on the traffic light information and the remaining distance, the vehicle in the passing speed range being allowed to pass through the intersection according to the light colors of the traffic light at the intersection, and a messaging unit configured to output a message of driving assistance information suggesting whether the vehicle should decelerate or whether the vehicle can pass through the traffic intersection in the passing speed range based on the passing speed range and a current speed of the vehicle, wherein the driving assistance system for vehicle includes a vehicle behavior storing unit configured to store content of the message and a behavior of the vehicle in response to the content of the message or transmits the content of the message and the behavior of the vehicle to the server.

Advantageous Effect of the Invention

According to the disclosure, a processing matched to the current condition can be conducted by the driving assistance system for vehicle.

DESCRIPTION OF EMBODIMENTS

In the following, an embodiment example of the disclosure will be explained.

Figure 1:
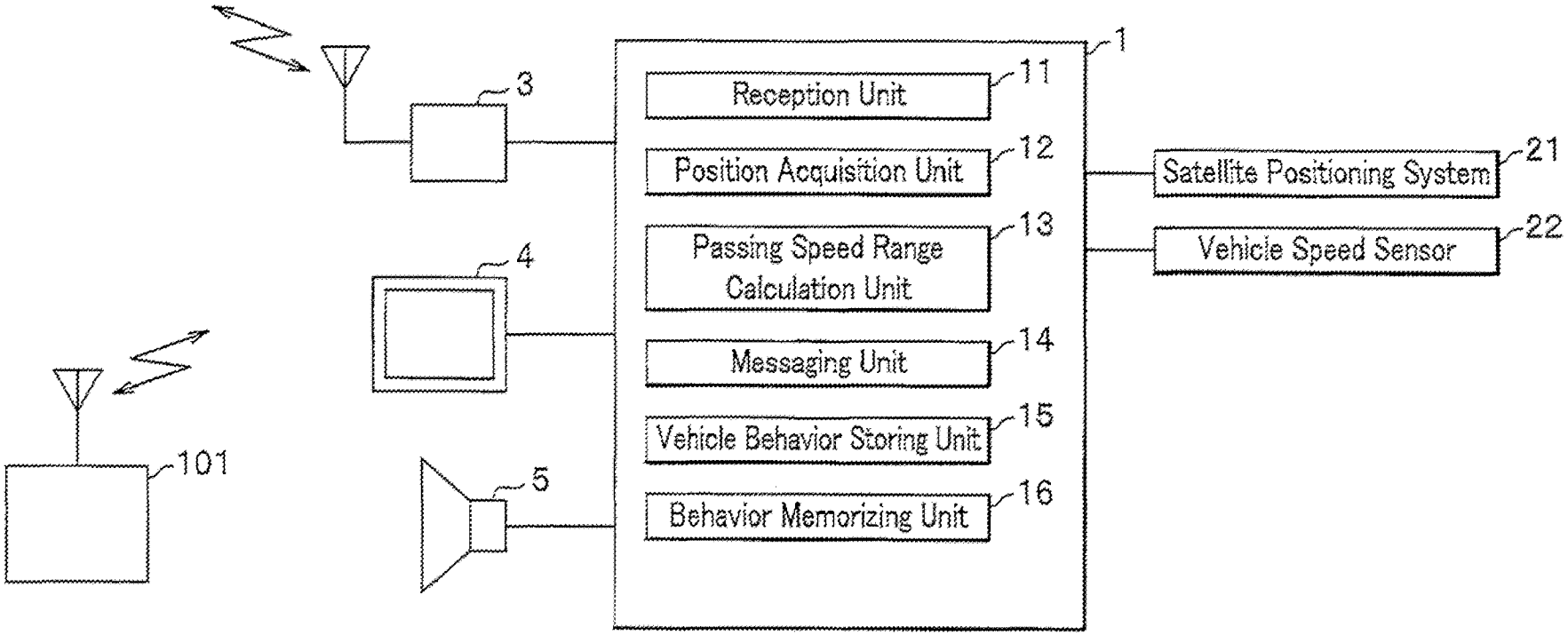
FIG. 1 is a block diagram showing a system configuration of an on-board driving assistance system for vehicle related to an embodiment example of the disclosure.
Figure 2:
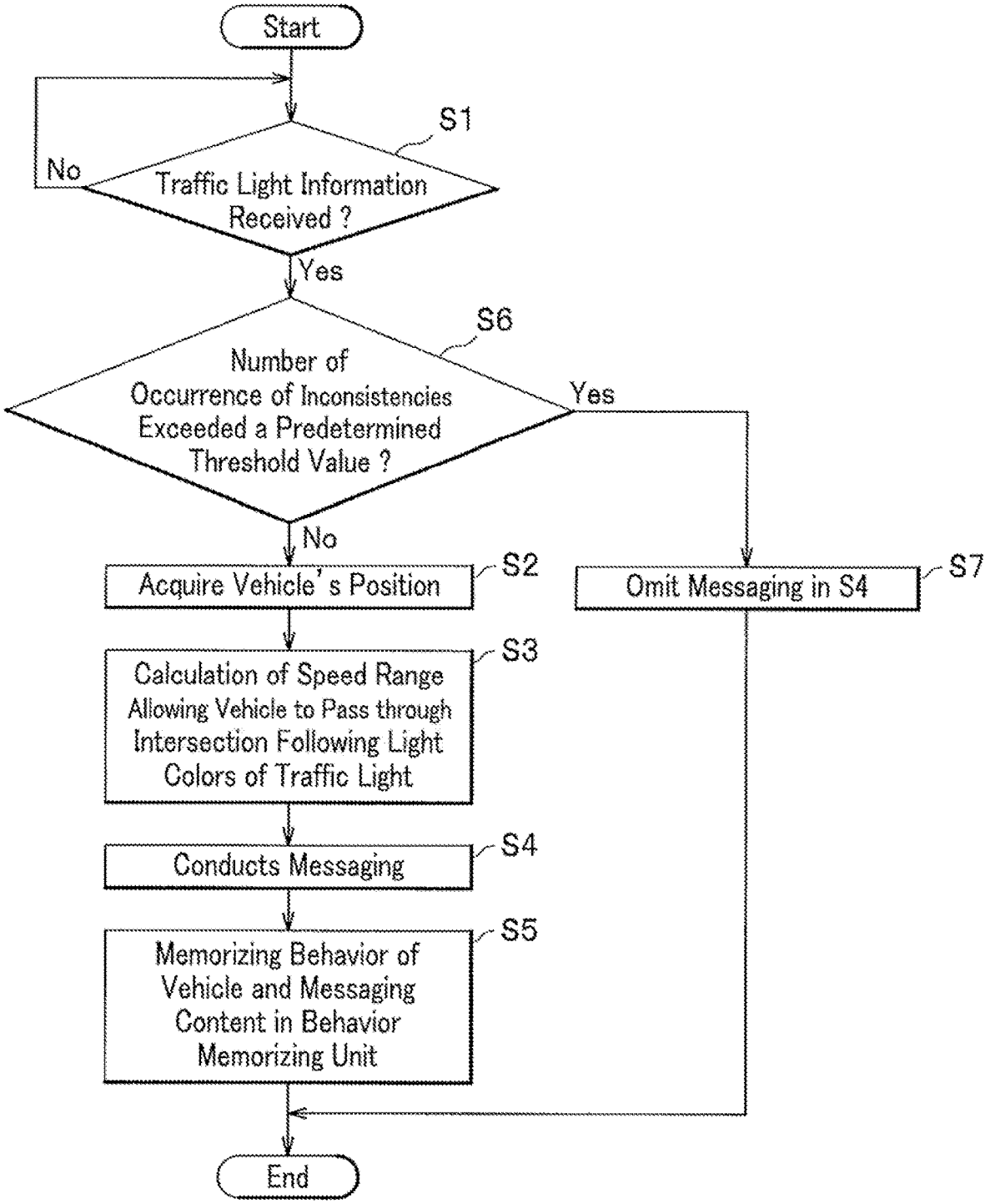
FIG. 2 is a flow-chart explaining the operation of an on-board driving assistance system for vehicle related to an embodiment example of the disclosure.

FIG. 1 is a block diagram showing a system configuration of an on-board driving assistance system for vehicle. The driving assistance system for vehicle 1 is configured with a microcomputer and so on and includes a transceiver 3 which receives delivery of traffic light information from a server 101 arranged externally close to the intersection, a display 4, and a sound device 5 which outputs sound.

The driving assistance system for vehicle 1 performs the functions of a reception unit 11, a position acquisition unit 12, a passing speed range calculation unit 13, a messaging unit 14, and a vehicle behavior storing unit 15. For example, the behavior memorizing unit 16 is a semiconductor memory for memorizing information.

The reception unit 11 receives the traffic light information at least a transition between first light color and second light color of a traffic light located at a traffic intersection and turn-on times of the first light color and the second light color. Table 1 shown below demonstrates an example of a delivered traffic light information that the current light color of the traffic light is green, the next color is yellow, and the time until the next color (time to turn from green to yellow) is 50 seconds.

TABLE 1

| Delivered Information | | | |
|---|---|---|---|
| | Delivered Traffic Light Information | | |
| Intersection | Current Color | Next Color | Time to Next Color |
| A | Green | Yellow | 50 seconds |

The position acquisition unit 12 acquires the position of the vehicle from a satellite positioning system 21, as explained later.

The passing speed calculation unit 13 calculates a speed range in which the vehicle can pass through the intersection in accordance with light colors of the traffic light, based on the traffic light information and the position of the vehicle.

The messaging unit 14 outputs a message content including a passing speed range as a driving assistance information based on the passing speed range and the current speed of the vehicle.

The vehicle behavior storing unit 15 stores in the memorizing unit 16 the message content and the behavior of the vehicle corresponding to the message content.

Table 2 shown below demonstrates a message content corresponding to a delivered information and an actual behavior corresponding thereto. In this example of Table 2, the message content corresponding to the delivered information from the server 101 is "passage assistance (content for assisting passage through an intersection)", and the "actual behavior" of the vehicle should be consistent with the message content which indicates that the vehicle passes the intersection. It should be noted that there arises an inconsistency between the "message content" and the "actual behavior", when the position of the vehicle measured with a satellite positioning system for example is different from the actual position of the vehicle, and when the vehicle is going to travel through the intersection B, not the intersection A.

TABLE 2

| Message content corresponding to delivered information and actual behavior corresponding thereto | | | | | |
|---|---|---|---|---|---|
| | Delivered Traffic Light Information | | | | |
| Intersection | Current Color | Next Color | Time to Next Color | Message Content | Actual Behavior |
| A | Green | Yellow | 50 seconds | Passage Assistance | Passage Action |

A satellite positioning system 21 such as GPS and a vehicle speed sensor 22 are connected to the driving assistance system for vehicle 1. The satellite positioning system 21 is provided to an on-board car navigation system.

Next, a particular processing content conducted by the driving assistance system for vehicle 1 is explained in reference to a flow-chart.

When the vehicle approaches to a traffic intersection, the reception unit 11 receives the traffic light information related to the traffic light of the intersection (Yes in S1). The traffic light information contains information of current light color, next light color, and time needed to transition from the present light color to the next light color regarding the intersection which is now being passed.

The processes in steps S6 and thereafter will be explained later. Next, the position acquisition unit 12 acquires a position of the vehicle from the satellite positioning system 21 (S2). The position of the vehicle can be determined with the satellite positioning system 21, and thereby the remaining distance on the map data from the vehicle's position to the traffic intersection is calculated. Next, the passing speed range calculation unit 13 calculates a speed range which allows passage through the intersection according to the light color of the traffic light, based on the traffic light information and the remaining distance (S3).

Next, the messaging unit 14 gives a message of a driving assistance information to the driver suggesting an action whether the vehicle should decelerate (and should stop before the traffic intersection) or whether the vehicle can pass through the traffic intersection based on the above calculated speed range and on the current speed (S4). This message may be given as an image and a sound by use of the display 4 and the sound device 5.

Next, the vehicle behavior storing unit 15 stores in the behavior memorizing unit 16 the message content and the vehicle's behavior corresponding to the message content (S5). Here, the stored content includes also the case that the driver has conducted an action of the vehicle neglecting the suggested action, wherein the vehicle's behavior was passing through the intersection, despite that the outputted message content was to decelerate the vehicle and stop before the intersection.

With help of accumulation of the stored information (S5), many examples, in which the message content (S4) and the vehicle's actual behavior are consistent or inconsistent, are collected. Such information is collected for each traffic intersection based on identification information of each intersection as contained in the traffic light information. Here, for such an intersection, where the number of times of inconsistencies found between the vehicle's actual behavior and the suggestion of the message content exceeds a predetermined threshold (Yes in S6), a reliability level of a message by the massaging unit 14 is decreased. In particular, for example, the processes in step of S2 and thereafter will not be conducted, whereby the messaging (S4) will be omitted.

Figure 3A:
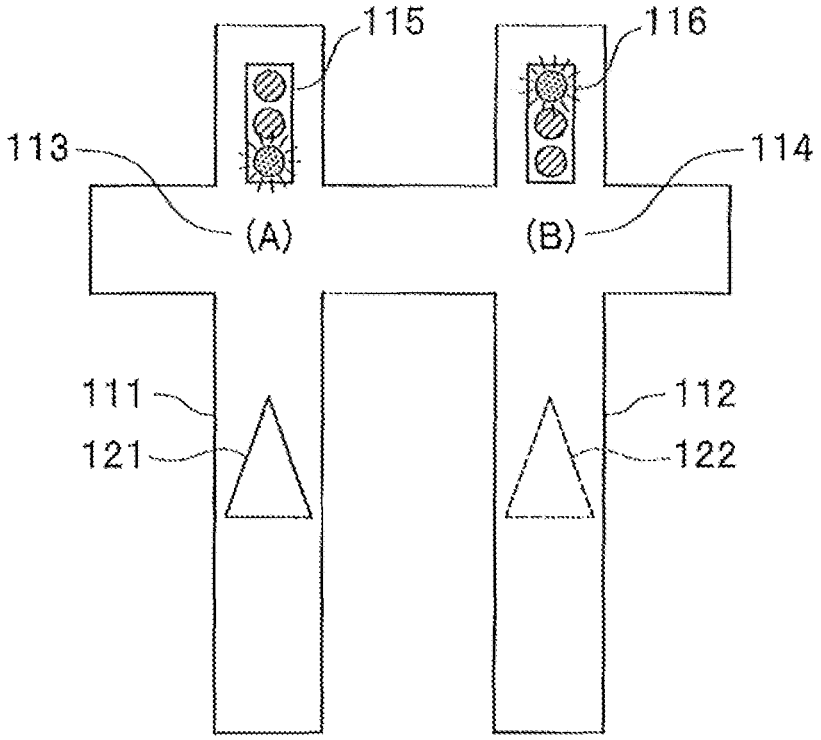
FIG. 3A is a planar representation explaining a tangible case which causes an inconsistency between the behavior of the vehicle and the message content.
Figure 3B:
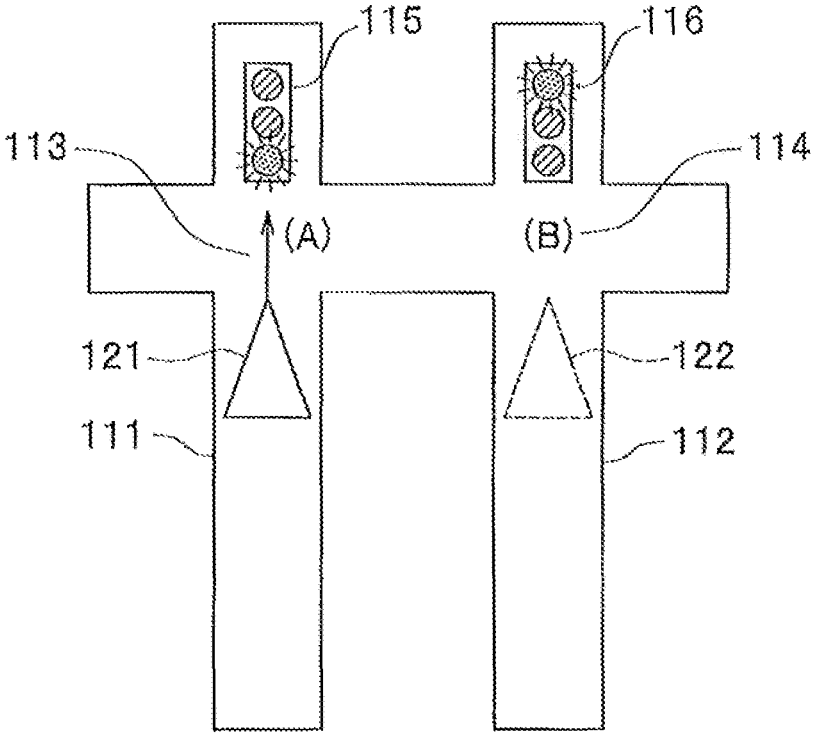
FIG. 3B is a planar representation explaining a tangible case which causes an inconsistency between the behavior of the vehicle and the message content.

Next, a case that an inconsistency arises between the vehicle's behavior and the suggestion in the message content is specifically explained. FIG. 3A and FIG. 3B are planar representations explaining a case which causes an inconsistency between the behavior of the vehicle and the message content. In FIGS. 3A and 3B, the traffic intersections 113 (intersection A) and 114 (intersection B) are present ahead of the vehicle on the parallelly running two roads 111, 112. At these intersections 113, 114, the traffic lights 115, 116 are respectively located (refer to FIG. 3A).

It should be noted that, in FIG. 3A and FIG. 3B, the light colors of the traffic light 115,116 are arranged from bottom to top in the order "green"→"yellow"→"red". For example, in FIG. 3A and FIG. 3B, the "green" light of the traffic light 115 is lit on, and the "red" light of the traffic light 116 is lit on.

In this example, in the traffic light information provided by the server of the traffic intersection 113 (not shown in FIGS. 3A, 3B), the currently lit light color is green, the next light color is yellow and the time required for changing from the current light color to the next light color is 50 seconds (refer to Table 3-1 as shown later. Further, the traffic light information provided from the server 101 at the intersection 114 is such that, for the traffic light 116, the current light color is red, the next light color is green and the time required to change color from the current red and to the next color green is 40 seconds (refer to Table 3-2 as shown later).

On the road 111, the vehicle 121 is travelling towards the intersection 113 (intersection A). However, an error in the measurement with the satellite positioning system 21 is caused by environmental condition, thereby the driving assistance system for vehicle 1 misidentifies that the vehicle 121 is travelling not on the road 111 but on the road 112 towards the intersection 114 (intersection B). The misidentified position 122 is shown with a dotted triangular mark.

Therefore, the driving assistance system for vehicle 1 determines that the vehicle 121 is travelling towards the intersection 114 (intersection B), and the driving assistance system for vehicle 1 gives a message to the driver to decelerate towards the intersection 114 (intersection B), as shown in Table 3-2. However, in reality, the vehicle 121 is travelling on the road 111 towards the intersection 113 (intersection A), as shown in Table 3-1.

Therefore, fundamentally in such a situation explained above, a message should be given on the display 4 (S4) to suggest a passage through the intersection (intersection A indicated with reference sign 113) and the driver should also make a maneuver to pass through the intersection (refer to Table 2). However, because such message is not given, the driver would make a maneuver to drive the vehicle to pass through the intersection 113, as if he ignores the message (S4) of the driving assistance system for vehicle 1 (refer to FIG. 3B). Thus, due to such behavior, an inconsistency arises between the vehicle's behavior and the message content as referred in S6. Namely, in this example, the cause of the inconsistency mentioned in S6 is an error generated in the measurement with the satellite positioning system 21.

TABLE 3-1

| Delivered information of the actually passed intersection A | | | |
|---|---|---|---|
| | Delivered Traffic Light Information | | |
| Intersection | Current Color | Next Color | Time to Next Color |
| A | Green | Yellow | 50 seconds |

TABLE 3-2

| Message content corresponding to erroneously delivered information and actual behavior corresponding thereto | | | | | |
|---|---|---|---|---|---|
| | Delivered Traffic Light Information | | | | |
| Inter-section | Current Color | Next Color | Time to Next Color | Message Content | Actual Behavior |
| B | Red | Green | 30 seconds | Deceleration Assistance | Passage Action |

It should be noted that there may be a case in which the problem is not caused on the satellite positioning system 21 but may be caused by that the information of the adjusted traffic light is not recorded in the server after the adjustment. In such a case, though the suggested intersection in the delivered message and the actually passed intersection are consistent, it may happen that the content of the delivered traffic light information is different from the actual situation.

According to the above explained embodiment example, when the satellite positioning system measures the vehicle's position erroneously, because the messaging unit 14 cannot provide a correct message (S4) to the driver, and the driving assistance system for vehicle 1 may conduct a processing matched to the actual condition, such as omitting the message to be provided.

It should be noted that, in S5, the vehicle behavior storing unit 15 may send the vehicle's behavior and the message content to the server 101, which server is the one that has transmitted the traffic light information, via the transceiver 3, in place of (or along with) storing in the behavior memorizing unit 16 the information of the vehicle's behavior and the message content. In this case, the server 101 decreases the level of reliability of the traffic light information, when the number of inconsistencies between the vehicle behavior and the message content exceeds a predetermined threshold value (similarly to the case of "Yes" in step S6), based on message content collected from a number of vehicles. In particular, for example, when the reliability of the traffic light information received by the driving assistance system for vehicle 1 in step S1 is low, the server 101 determines not to transmit the traffic light information. However, in this case, in step S1, when the number of inconsistencies between the vehicle behavior and the message content becomes less than a predetermined threshold value, the server 101 may resume transmitting the traffic light information to be received by the driving assistance system for vehicle 1.

Further, it is also possible that major parts of the driving assistance system for vehicle 1 can be configured on the server 101. For example, the passing speed range calculation unit 13 and the messaging unit 14 are provided on the server 101, and the server 101 may be configured in such a way that the message is outputted to the display 4 and sound device 5 of the vehicle based on the information of the message from the messaging unit 14, the message being given to the driver (namely a driving assistance system for vehicle based on cooperation of the on-board devices and the server 101 is configured). In this case, it is assumed that the vehicle transmits the vehicle's positional information via communication and the server 101 conducts necessary calculations such as calculation of the passing speed range, and that the server 101 transmits the information, which should be given to the driver as a message, to the vehicle.

It should be noted that a system for measuring the position of vehicle without use of the satellite positioning system may be employed in place of the position acquisition unit 12 explained above, whereby a position measuring function is provided on the server 101. For example, a system arranged at an intersection for measuring the position of the vehicle can be linked to the server 101.

It should be noted that, though the traffic lights at the intersections are assumed to be the objects in the present embodiments, the traffic lights may not be necessarily of such ones as arranged at an intersection. In the latter case, the messaging unit may output information merely regarding passage of the vehicle by the traffic light.

The invention claimed is:

1. A driving assistance system for vehicle, comprising:

a reception unit configured to receive from an external server traffic light information including at least a transition between first light color and second light color of the traffic light and turn-on times of the first light color and the second light color, a position acquisition unit configured to acquire a position of the vehicle, a passing speed range calculation unit configured to calculate a passing speed range of the vehicle, based on the traffic light information and on the position of the vehicle, the vehicle in the passing speed range being allowed to pass through the intersection according to the first light color and the second light color of the traffic light, and a messaging unit configured to output a message of driving assistance information including the passing speed range based on the passing speed range and on a current speed of the vehicle, wherein the driving assistance system for vehicle comprises a vehicle behavior storing unit configured to store content of the message and a behavior of the vehicle in response to the content of the message or transmit the content of the message and the behavior of the vehicle to the server, and a reliability level of the message from the messaging unit is decreased, when the number of times that the behavior of the vehicle and the content of the message are inconsistent exceeds a predetermined threshold.

2. The driving assistance system for vehicle according to claim 1, wherein the reception unit, the position acquisition unit, the passing speed range calculation unit, and the messaging unit configure an on-board system provided on the vehicle.

3. The driving assistance system for vehicle according to claim 1, wherein the position acquisition unit, the passing speed range calculation unit, and the messaging unit configure a system provided on the server, and a message is given to a driver of the vehicle based on a message of the messaging unit provided on the server.

* * * * *